US006986504B1

(12) United States Patent
Eby et al.

(10) Patent No.: US 6,986,504 B1
(45) Date of Patent: Jan. 17, 2006

(54) TOOL FOR PULLING NAILS AND OTHER PROTRUSIONS

(75) Inventors: Eric H. Eby, Lone Rock, WI (US); Rick Parduhn, Richland Center, WI (US)

(73) Assignee: Halvor, Inc., Lone Rock, WI (US)

( * ) Notice: Subject to any disclaimer, the term of this patent is extended or adjusted under 35 U.S.C. 154(b) by 0 days.

(21) Appl. No.: 11/070,470

(22) Filed: Mar. 1, 2005

(51) Int. Cl.
*B66F 15/00* (2006.01)

(52) U.S. Cl. ..... 254/25; 81/20

(58) Field of Classification Search ..... 254/25, 254/21, 26 R, 131, 18; 81/177.2, 177.7, 81/177.8, 180.1, 119, 20
See application file for complete search history.

(56) References Cited

U.S. PATENT DOCUMENTS 120,304 A * 10/1871 McBride ..... 81/119
1,709,240 A * 4/1929 Wass ..... 254/25
5,871,204 A * 2/1999 Spirer ..... 254/26 R
5,931,063 A * 8/1999 Kuo ..... 81/119
2004/0069978 A1 * 4/2004 Whelan ..... 254/25

* cited by examiner

*Primary Examiner*—Lee D. Wilson
(74) *Attorney, Agent, or Firm*—Craig A. Fieschko, Esq.; DeWitt Ross & Stevens S.C.

(57) ABSTRACT

A pulling tool for pulling nails, screws, rivets, pegs, or other protrusions includes a jaw which may be opened to receive the head of the protrusion. The jaw is then at least partially closed against the protrusion, and when the handle of the tool is pulled, the jaw is both urged shut and also away from the surface from which the protrusion extends. Thus, as the protrusion is pulled, its shaft is also more tightly grasped, which helps to pull the protrusion from the surface without stripping off its head/cap. The pulling tool can be provided as a part of a hammer, crowbar, or other conventional tool.

20 Claims, 2 Drawing Sheets

TOOL FOR PULLING NAILS AND OTHER PROTRUSIONS

FIELD OF THE INVENTION

This document concerns an invention relating generally to hand tools, and more specifically to hand tools which allow the pulling of nails or other small protrusions (screw or rivet heads, nuts, pegs, etc.) from the surfaces from which they protrude.

BACKGROUND OF THE INVENTION

Claw hammers are perhaps the best known tool for pulling nails from boards or other surfaces. The claw hammer has a curved top bearing surface which ends in a furcated tail or "claw" opposite the hammer head. When a nail is to be pulled, the nail head is situated between the furcations, and the top bearing surface is rolled along the board (or other surface from which the protrusion extends) in a tail-to-head direction so that the curvature of the bearing surface lifts the furcations (and thus the nail head) from the board. The problem with this arrangement is that the cap of the nail head—which bears against the furcations of the hammer tail, with the nail shaft resting in the crotch between the furcations—may yield if the nail is firmly grasped by the board, effectively stripping the nail cap from the nail head. The furcations are then unable to grasp the nail head, and the claw hammer can no longer pull the nail. Thus, claw hammers are often ineffective in pulling nails or other protrusions where such protrusions lack sturdy, well-defined caps (or where they lack other heads of greater diameter than the adjacent part of the protrusion).

SUMMARY OF THE INVENTION

The invention involves a pulling tool for pulling out embedded nails and other protruding objects, with the invention being intended to at least partially solve the aforementioned problems by positively grasping the nail during pulling, as opposed to passively doing so as in a claw hammer. To give the reader a basic understanding of some of the advantageous features of the invention, following is a brief summary of the preferred versions 100 and 200 of the pulling tool shown in FIGS. 1*a*–1*d* (which will be collectively referred to as FIG. 1) and FIGS. 2*a*–2*c* (which will be collectively referred to as FIG. 2). As this is merely a summary, it should be understood that more details regarding the preferred versions may be found in the Detailed Description set forth elsewhere in this document. The claims set forth at the end of this document then define the various versions of the invention in which exclusive rights are secured.

Preferred versions of the pulling tool 100/200 include an elongated handle 102/202 having a tool head 104/204 at its end, an anchor 106/206 fixed with respect to the handle 102/202 (preferably on the tool head 104/204), and a jaw 108/208 which is pivotable with respect to the anchor 106/206. The jaw 108/208 includes a bearing surface 110/210 which preferably curves in an arc from a jaw tip 112/212 to a jaw tail 114/214. The bearing surface 110/210 extends along planes perpendicular to the axis about which the jaw 108/208 pivots (with the pivot 116/216 for the jaw 108/208 being situated along the jaw 108/208 between its jaw tip 112/212 and its jaw tail 114/214), such that the bearing surface 110/210 may "roll" or pivot over a surface (such as a board with a nail embedded therein) along planes coinciding with the planes along which the jaw 108/208 pivots. A cutout 118/218 (e.g., an aperture in the jaw 108/208) is situated between the jaw tip 112/212 and the jaw tail 114/214, and extends through the jaw 108/208 from the bearing surface 110/210. One side of the cutout 118/218 is bounded by a jaw grasping face 120/220 which is situated adjacent to the pivot 116/216, and which faces toward the jaw tail 114/214. The jaw grasping face 120/220 is preferably oriented at least substantially perpendicular to the bearing surface 110/210.

The jaw 108/208 is pivotable between an open state (FIGS. 1*a*–1*b* and 2*b*) and a closed state (FIGS. 1*c*–1*d* and 2*c*). In the open state, an open mouth 122/222 is defined in the bearing surface 110/210 between the jaw grasping face 120/220 and the anchor 106/206, allowing a nail or other protrusion to be inserted into (or removed from) the mouth 122/222. As the jaw 108/208 is moved from the open state to the closed state, the anchor 106/206 moves into the cutout 118/218 of the jaw 108/208 and toward the jaw grasping face 120/220 until it sits closely adjacent the jaw grasping face 120/220. At this point, the mouth 122/222 is at least substantially closed and a nail or other protrusion may be grasped in the mouth 122/222 (i.e., between the anchor 106/206 and the jaw grasping face 120/220).

To pull a nail extending from a board, or to grasp and pull another protrusion (e.g., a peg, rivet head, protruding nut, etc.), the jaw 108/208 is pivoted to its open state and the protrusion is inserted in the open mouth 122/222 against the jaw grasping face 120/220, and the surrounding bearing surface 110/210 of the jaw 108/208 may be situated upon the board or other surface from which the protrusion extends. The jaw 108/208 may then be pivoted to its closed state such that the mouth 122/222 closes about the protrusion. The handle 102/202 of the pulling tool may then be pulled so that the handle 102/202 travels in the direction in which the jaw tail 114/214 points or extends, causing the bearing surface 110/210 to roll across the surface from which the protrusion extends. Such rolling starts with the regions of the bearing surface 110/210 nearer the jaw tip 112/212 contacting the board or other surface from which the protrusion extends, and ends with regions of the bearing surface 110/210 nearer the jaw tail 114/214 contacting the board/surface. Owing to the curvature of the bearing surface 110/210, this action begins lifting the mouth 122/222 away from the surface from which the protrusion extends, and at the same time, the jaw tail 114/214 presses against the surface, thereby serving to more firmly close the mouth 122/222 about the protrusion. As a result, the harder one attempts to pull a nail or other protrusion, the more firmly the jaw 108/208 is urged shut, and the more tightly the protrusion is grasped. This positive grip even allows the pulling tools 100/200 to pull headless nails out of boards, since the grasp of their jaws 108/208 on a headless nail shaft is sufficiently strong to allow the nail to be pulled. In tests, the pulling tools 100/200 have even been capable of grasping a pointed tip of a nail protruding from a board, and pulling the entirety of the nail through the board tip-first (and cap last, with the cap being bent to trail behind).

As can be seen from the drawings, the pulling tool can be provided in a variety of forms, such as in a crowbar 100 (as shown in FIG. 1) or in a hammer 200 (as shown in FIG. 2). In the crowbar 100, the anchor 106—which is defined at the tool head 104 of the handle 102—is pivotally affixed within the cutout 118 by the pivot 116. The jaw tip 112 is furcated, and is equivalent to the working end of the bend of a standard crowbar 100. The jaw tail 114 may be furcated as well if desired. The crowbar 100 can be used as a pulling tool as described above, or as a standard crowbar. When using the crowbar 100 in standard fashion, the jaw 108 is urged into its closed state so that the anchor 106 bears against the jaw grasping face 120 (see FIGS. 1*b* and 1*d*), thereby holding the jaw 108 immobile with respect to the handle 102 so that the jaw 108 will not yield during crowbar use as the jaw tip 112 is used to lift one object from another.

In the hammer 200 (FIG. 2), the pivot 216 is provided at the jaw tip 212, and the cutout 218 is spaced from (but adjacent to) the jaw tip 212 and the pivot 216. The anchor 206, which is (as with the crowbar 100) effectively defined as an extension of the handle 202, is not pivotally pinned within the cutout 218, but instead is received within the cutout 218 as the jaw 208 moves toward its closed state. It is useful to provide the end of the hammer handle 202 opposite the tool head 204 as a sleeve 224 which may be telescopically extended from the handle shaft 226 (and fastened at a desired extension by a threaded fastener 228), so that the handle 202 can be extended to provide better leverage when pulling a nail or other protrusion.

Further advantages, features, and objects of the invention will be apparent from the following detailed description of the invention in conjunction with the associated drawings.

DETAILED DESCRIPTION OF PREFERRED VERSIONS OF THE INVENTION

Figure 1A:
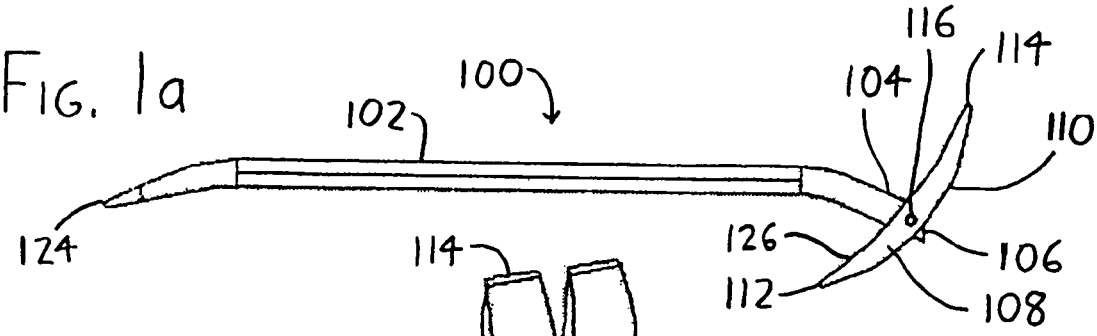
FIGS. 1*a*–1*d* present perspective views of a first version of a pulling tool which exemplifies the invention, wherein the pulling tool is provided in the form of a crowbar 100 (or more accurately a crowbar head), with FIGS. 1*a* and 1*b* showing the jaw 108 in the open state (with the mouth 122, FIG. 1*b*, being open to receive a nail head or other protrusion), and FIGS. 1*c* and 1*d* showing the jaw 108 in the closed state.
Figure 1B:
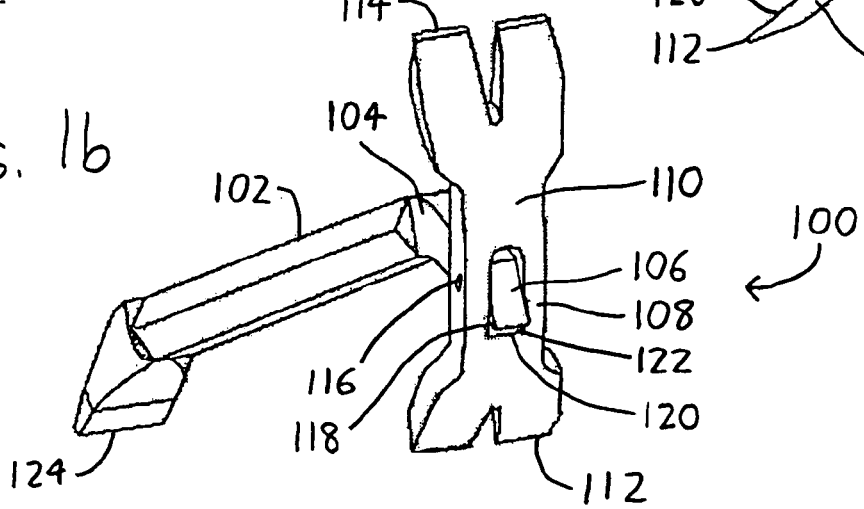
Figure 1C:
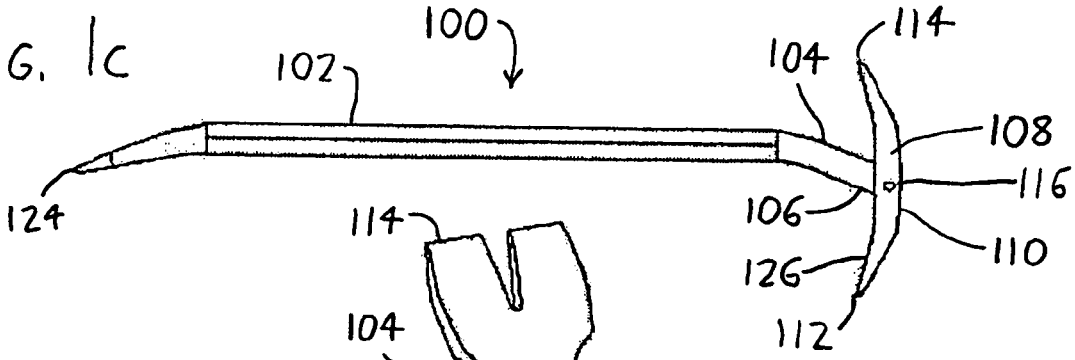
Figure 1D:
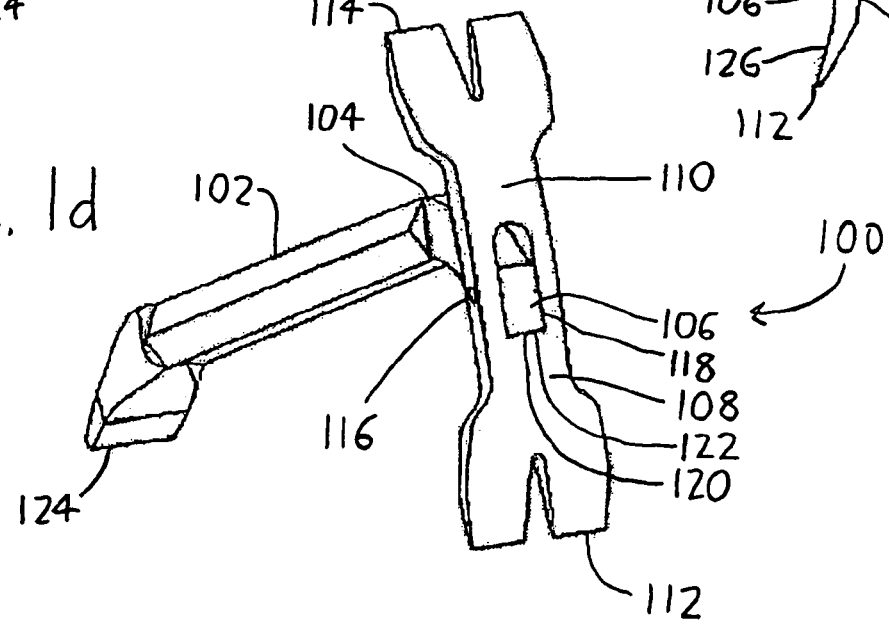

Referring initially to FIGS. 1*a*–1*d* (which are collectively referred to as FIG. 1), the pulling tool is presented in the form of a crowbar 100. The crowbar 100 has an elongated handle 102 with a tool head 104 at one end and a prying wedge 124 at its opposite end. The tool head 104 defines an anchor 106 against which a nail or other protrusion will be grasped, and it includes a jaw 108 which is pivotally affixed to the anchor 106 at pivot 116. The jaw 108 includes a jaw tip 112 and an opposing jaw tail 114, both of which are preferably defined as furcated prying wedges. A top bearing surface 110 curves in an arc from the jaw tip 112 to the jaw tail 114. An opposing jaw bottom surface 126 (FIGS. 1*a* and 1*c*), which faces the handle 102, also extends between the jaw tip 112 and the jaw tail 114. A cutout 118, defined as an aperture extending between the bearing surface 110 and the jaw bottom surface 126, is situated between the jaw tip 112 and the jaw tail 114. One side of the cutout 118 is bounded by a jaw grasping face 120 which is situated adjacent to the pivot 116, and which faces toward the jaw tail 114. The anchor 106 of the tool head 104 is pinned by the pivot 116 within the cutout 118, and between the jaw tip 112 and jaw tail 114, such that the jaw 108 can pivot 116 between an open state (FIGS. 1*a*–1*b*) and a closed state (FIGS. 1*c*–1*d*). In the open state, an open mouth 122 (FIG. 1*b*) is defined in the bearing surface 110 between the jaw grasping face 120 and the anchor 106, allowing a nail or other protrusion to be inserted into (or removed from) the mouth 122. As the jaw 108 is pivoted from the open state to the closed state, the anchor 106 moves further into the cutout 118 of the jaw 108 and toward the jaw grasping face 120 until it sits closely adjacent the jaw grasping face 120. At this point, the mouth 122 is at least substantially closed, and a nail or other protrusion previously inserted into the open mouth 122 may be grasped in the mouth 122 between the anchor 106 and the jaw grasping face 120. Both the jaw grasping face 120 and the opposing face of the anchor 106 are preferably oriented at least substantially perpendicular to the bearing surface 110 when the jaw 108 is in its closed state so as to better grasp a nail head or other protrusion when the bearing surface 110 rests against the surface from which the protrusion extends (it being assumed that such a protrusion will usually protrude perpendicularly from such a surface).

To pull a nail extending from a board (or to grasp and pull another protrusion), the jaw 108 is pivoted to its open state (FIGS. 1*a*–1*b*) and the protrusion is inserted in the open mouth 122 against the jaw grasping face 120, and the surrounding bearing surface 110 of the jaw 108 may be situated upon the board or other surface from which the protrusion extends. The handle 102 is then pivoted so that the jaw 108 is in its closed state (FIGS. 1*c*–1*d*) such that the mouth 122 closes about the protrusion, with the protrusion being sandwiched between the anchor 106 and the jaw bearing surface 110. The handle 102 of the pulling tool 100 may then be pulled so that the handle 102 travels in the direction in which the jaw tail 114 points/extends, with the bearing surface 110 rolling across the surface from which the protrusion rises. Owing to the curvature of the bearing surface 110, this rolling action begins lifting the mouth 122 away from the surface from which the protrusion extends, thereby pulling the nail or other protrusion. At the same time, as the bearing surface 110 rolls across the surface from which the protrusion extends (with the bearing surface 110 rolling from its regions nearer its jaw tip 112 towards regions nearer its jaw tail 114), the pressure of the jaw tail 114 against the surface from which the protrusion extends will force the jaw 108 closed, thereby serving to more firmly clamp the mouth 122 about the protrusion. As a result, the harder one attempts to pull a nail or other protrusion, the more firmly it is grasped between the jaw bearing surface 110 and the anchor 106. By continuing to roll the bearing surface 110 across the surface from which the protrusion extends, the protrusion will be pulled from the surface. The crowbar 100 can then be removed from the surface, and the jaw 108 may be pivoted to its open state to release and discard the protrusion.

The crowbar 100 is also usable as a standard crowbar 100. Here, where the head of the crowbar 100 is to be used in standard fashion, the jaw 108 is simply pivoted into its closed state (FIGS. 1*c*–1*d*) so that the anchor 106 bears against the jaw grasping face 120. When the jaw tip 112 is then used to pry objects apart, the jaw 108 is effectively held immobile with respect to the handle 102 so that the jaw 108 will not yield during crowbar use.

Figure 2A:
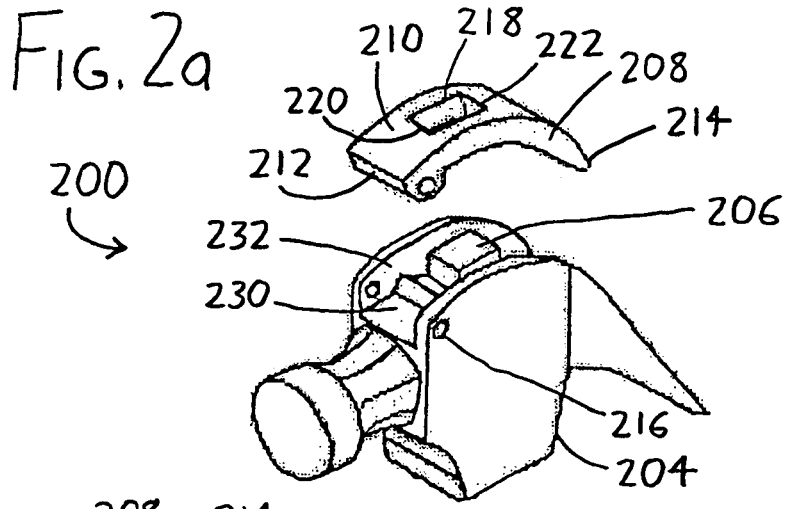
FIGS. 2*a*–2*c* present perspective views of a second version of a pulling tool which exemplifies the invention, wherein the pulling tool is provided in the form of a hammer 200 (or more accurately a hammer head), with FIG. 2*a* presenting an exploded (disassembled) perspective view of the head of the hammer 200, FIG. 2*b* showing the jaw 208 in the open state (with the mouth 222 being open to receive a nail head or other protrusion), and FIG. 2*c* showing the jaw 208 in the closed state.
Figure 2B:
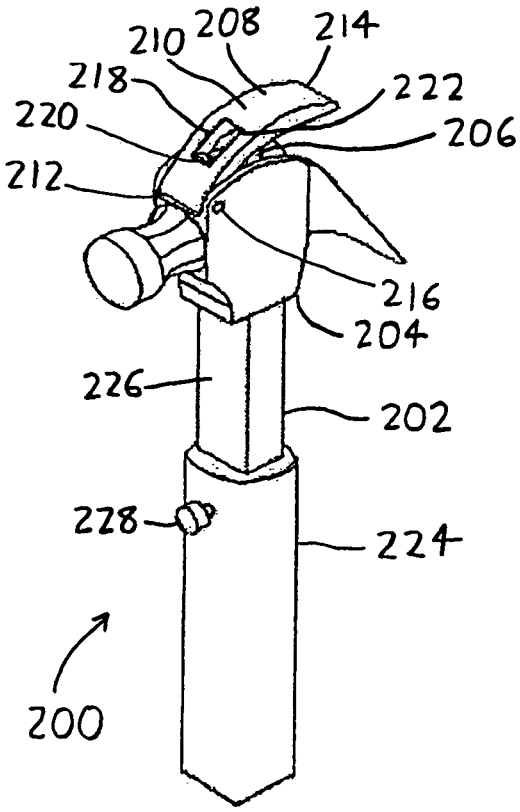
Figure 2C:
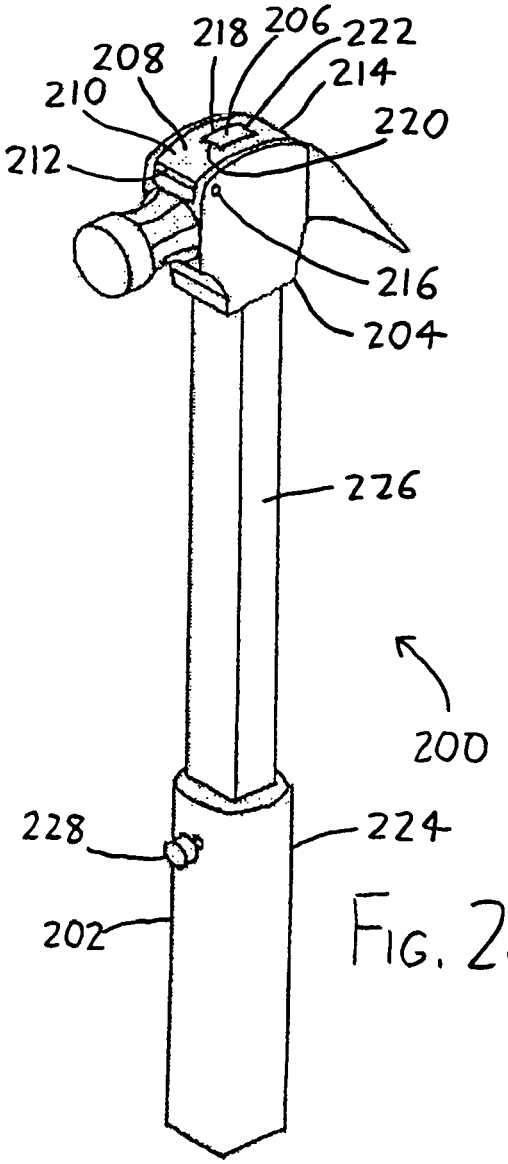

Referring then to FIGS. 2*a*–2*c* (which are collectively referred to as FIG. 2), the pulling tool is presented in the form of a hammer 200 (or more accurately a hammer head, as depicted in FIG. 2*a*, which is preferably provided in conjunction with the handle 202 depicted in FIGS. 2*b*–2*c*). The handle 202 usefully includes a sleeve 224 which may be telescopically extended from the handle shaft 226 as shown in FIGS. 2*b*–2*c*, and which may be fastened at a desired extension by a threaded fastener 228 extending through the sleeve 224 to engage the handle shaft 226. Such an extendible handle 202 allows a user to attain better leverage when using the hammer 200 to pull a nail or other protrusion.

The hammer head includes an anchor 206 (best seen in FIG. 2*a*) which is fixed with respect to the tool head 204 and the handle 202, and which is defined as a block protruding from a depressed head surface 230 (also best seen in FIG. 2*a*) and spaced from opposing flange-like head sides 232 which rise from the head surface 230. A jaw 208 is pivotally affixed to the head sides 232 at a pivot 216 provided on the jaw tip 212, and the jaw 208 further includes a jaw tail 214 opposite the jaw tip 212, a top bearing surface 210 curving in an arc between the jaw tip 212 and the jaw tail 214, and a lower jaw surface (not shown) between the jaw tip 212 and the jaw tail 214 and opposite the jaw bearing surface 210. The jaw 208 can thereby rotate about the pivot 216 toward and away from the anchor 206.

A cutout 218 is defined in the jaw 208 between its bearing surface 210 and its lower jaw surface, and between the jaw tip 212 and the jaw tail 214. One side of the cutout 218 is bounded by a jaw grasping face 220 which is situated adjacent to the pivot 216 and which faces toward the jaw tail 214. When the jaw 208 pivots from its open state (shown in FIG. 2*b*) with its tail 214 spaced from the depressed head surface 230, to its closed state (shown in FIG. 2*c*) with its tail 214 closely adjacent to the depressed head surface 230, the anchor 206 moves into the cutout 218 to be complementarily received therein. Thus, when the jaw 208 is in its open state, an open mouth 222 is defined in the bearing surface 210 between the jaw grasping face 220 and the anchor 206, allowing a nail or other protrusion to be inserted into (or removed from) the mouth 222. As the jaw 208 is moved from the open state to the closed state, the anchor 206 moves into the cutout 218 of the jaw 208 and toward the jaw grasping face 220 until it sits closely adjacent the jaw grasping face 220. At this point, the mouth 222 is at least substantially closed and a nail or other protrusion may be grasped in the mouth 222 (i.e., between the anchor 206 and the jaw grasping face 220). The jaw grasping face 220, as well as the face of the anchor 206 against which the jaw grasping face 220 rests when the jaw 208 is in its closed state, are preferably oriented at least substantially perpendicular to the bearing surface 210 to better grasp any protrusion situated in the mouth 222.

To use the hammer 200 to pull a nail (or another protrusion) extending from a board or other surface, a user may use the furcated claw of the hammer 200 in standard fashion (the furcations not being visible in FIG. 2), or may instead use the jaw 208. The jaw 208 is pivoted to its open state (FIG. 2*b*) and the protrusion is inserted against the jaw grasping face 220 in the open mouth 222. The surrounding bearing surface 210 of the jaw 208 is situated upon the board or other surface from which the protrusion extends. The jaw 208 is then pivoted toward its closed state such that the mouth 222 closes about the protrusion, with the protrusion being sandwiched between the jaw grasping face 220 and the anchor 206. The handle 202 of the pulling tool may then be pulled so that the handle 202 travels in the direction in which the jaw tail 214 (and the claw of the hammer 200) points, with the bearing surface 210 rolling across the surface from which the protrusion extends. Owing to the curvature of the bearing surface 210, the mouth 222 begins lifting away from the surface from which the protrusion extends, thereby pulling the protrusion from its surrounding surface. At the same time, the pressure on the bearing surface 210 at the jaw tail 214 serves to more firmly close the mouth 222 about the protrusion. As a result, the harder one pulls the nail or other protrusion, the more firmly it is grasped during such pulling.

From the differing configurations of the crowbar 100 and the hammer 200, it should be understood that the general configuration of the pulling tool can vary substantially (and can vary quite substantially from the versions shown in the accompanying drawings). It is emphasized that the depicted crowbar 100 and hammer 200 are merely exemplary, and various modifications are also considered to be within the scope of the invention. As examples, the size and configuration of the jaw 108/208 can vary substantially, and as the foregoing examples show, the location of the pivot 116/216 be changed. The cutout 118/218 need not be provided as an aperture bounded by the jaw 108/208 on all sides, but could rather be provided as a slot which extends inwardly from one of the sides of the jaw 108/208, as well as from its bearing surface 110/210 to its jaw bottom surface (though this arrangement is not preferred). The jaw grasping face 120/220 need not be perpendicular to the adjacent bearing surface 110/210, and could instead define a wedge- or chisel-shaped face (which may slightly protrude above the surrounding surface of the jaw 108/208), so that the jaw grasping face 120/220 may "dig" beneath the cap of a nail or other fastener to better grip it. Additionally, the jaw grasping face 120/220 may be notched or furcated so that the notch may receive the shaft of a nail or other protrusion. Alternatively, the jaw grasping face 120/220 could have a sharpened wedge- or chisel-shaped face so that a protrusion is cut off by the pulling tool rather than pulled. Additionally or alternatively, the face of the anchor 106/206 which opposes the jaw grasping face 120/220 (and abuts the jaw grasping face 120/220 when the jaw 108/208 is in its closed state) could also have a notched/furcated surface, or a sharpened surface, to attain the foregoing objectives. The bearing surface 110/210 need not be curved, but can simply be formed as (for example) a flat surface whereby a protrusion is pulled not so much by a rolling action, but more of a levering action. Additionally, the bearing surface 110/210 need not be continuous (i.e., it might include a valley or other depression formed therein), though it preferably has a continuous contour/curvature so that any rolling action generated by the bearing surface is smooth.

The pulling tool may also be embodied in a variety of forms other than as a crowbar or hammer, e.g., it may be provided solely as a pulling tool (without hammer or crowbar structure), as by removing the pounding face and the claw of the hammer 200. The pulling tool could also be provided as a member which clamps or bolts onto preexisting separate tools. For example, considering the hammer 200, the top of the tool head 204 (i.e., the part defining the anchor 206, jaw 208, etc.) could be formed as a separate member which can be bolted or otherwise fastened atop a preexisting hammer, so that the hammer could be retrofit to attain the invention.

The invention is not intended to be limited to the preferred versions described above, but rather is intended to be limited only by the claims set out below. Thus, the invention encompasses all different versions that fall literally or equivalently within the scope of these claims.

What is claimed is:

1. A pulling tool for pulling out embedded nails and other protruding objects, the pulling tool comprising:

a. a handle;

b. an anchor fixed with respect to the handle;

c. a jaw having:

(1) a pivot about which the jaw pivots with respect to the anchor, (2) a bearing surface extending from a jaw tip to a jaw tail, (3) a cutout extending through the jaw from the bearing surface, the cutout being:

(a) situated between the jaw tip and the jaw tail, and (b) bounded on one side by a jaw grasping face;

wherein the jaw pivots between:

A. a closed state wherein the anchor rests within the cutout of the jaw and closely adjacent the jaw grasping face, whereby a nail or other protrusion may be grasped between the anchor and the jaw grasping face; and B. an open state wherein the jaw grasping face is spaced from the anchor to define a mouth therebetween, whereby a nail or other protrusion may be inserted into or removed from the mouth.

2. The pulling tool of claim 1 wherein the jaw grasping face is situated adjacent the pivot.

3. The pulling tool of claim 1 wherein the jaw grasping face faces toward the jaw tail.

4. The pulling tool of claim 1 wherein the jaw grasping face is at least substantially perpendicular to the bearing surface.

5. The pulling tool of claim 1 wherein the bearing surface continuously curves between the cutout and the jaw tail such that the bearing surface may smoothly roll across a surface from which a nail or other protrusion extends.

6. The pulling tool of claim 1 wherein the cutout is defined by an aperture in the jaw, the aperture having a perimeter bounded by the jaw.

7. The pulling tool of claim 6 wherein the anchor is pivotally affixed within the cutout by the pivot.

8. The pulling tool of claim 1 wherein the jaw tail is furcated.

9. The pulling tool of claim 8 wherein the jaw tip is furcated.

10. The pulling tool of claim 1 wherein:

a. the handle defines a crowbar handle, and b. the jaw defines at least a portion of a crowbar head.

11. The pulling tool of claim 1 wherein:

a. the pivot is provided at the jaw tip, and b. the cutout is spaced from, but adjacent to, the jaw tip and the pivot.

12. The pulling tool of claim 1 wherein:

a. the handle defines a hammer handle, and b. the anchor extends from a hammer head.

13. The pulling tool of claim 1 wherein the handle is elongated and telescopically extendable.

14. A pulling tool for pulling out embedded nails and other protruding objects, the pulling tool comprising:

a. an elongated handle;

b. an anchor fixed with respect to the handle; and c. a jaw including:

(1) a bearing surface extending from a jaw grasping face to a jaw tail, wherein the jaw grasping face faces toward the jaw tail; and (2) a pivot whereby the jaw pivots with respect to the anchor between:

(i) an open state wherein a mouth is defined:

1) upon the bearing surface, and 2) adjacent the jaw grasping face, whereby a nail or other protrusion may be fit into the mouth; and (ii) a closed state wherein the mouth is at least substantially closed, whereby the mouth may be closed about the nail or other protrusion.

15. The pulling tool of claim 14 wherein the jaw grasping face is situated adjacent the pivot.

16. The pulling tool of claim 14 wherein:

a. a cutout is defined in the bearing surface of the jaw; and b. a portion of the cutout is bounded by the jaw grasping face.

17. The pulling tool of claim 16 wherein the jaw receives the anchor within the cutout when the jaw is in its closed state.

18. A pulling tool for pulling out embedded nails and other protruding objects, the pulling tool comprising:

a. an elongated handle; and b. a tool head at the end of the handle, the tool head including:

(1) an anchor fixed with respect to the handle, and (2) a jaw pivotable with respect to the handle:

(a) the jaw including a bearing surface curving in an arc:

(i) away from the pivot to a jaw tail, and (ii) along planes perpendicular to the axis about which the jaw pivots, (b) the jaw pivoting between:

(i) an open state wherein a mouth is defined between the jaw and the anchor, whereby a nail or other protrusion may be fit into the mouth, and (ii) a closed state adjacent the anchor, whereby the mouth may be closed about the nail or other protrusion;

wherein the mouth opens upon the bearing surface when the jaw is in the open state.

19. The pulling tool of claim 18 wherein:

a. the jaw has a cutout extending into the bearing surface, and b. the anchor extends into the cutout when the jaw is in its closed state.

20. The pulling tool of claim 19 wherein:

a. the cutout is at least partially bounded by a jaw grasping face, and b. the mouth is defined between the anchor and the jaw grasping face.

* * * * *